US005484247A

United States Patent [19]

Clark et al.

[11] Patent Number: 5,484,247

[45] Date of Patent: Jan. 16, 1996

[54] BAG BREAKER

[75] Inventors: Brian K. Clark; Roy R. Miller, both of Eugene, Oreg.

[73] Assignee: Bulk Handling Systems, Inc., Eugene, Oreg.

[21] Appl. No.: 243,849

[22] Filed: May 16, 1994

[51] Int. Cl.[6] ..... B65G 69/00

[52] U.S. Cl. ..... 414/412; 414/786; 83/18

[58] Field of Search ..... 414/412, 786; 241/193, 195; 83/18, 492, 493, 494

[56] References Cited

U.S. PATENT DOCUMENTS

| | | | |
|---|---|---|---|
| 3,596,842 | 8/1971 | Barber | 414/412 X |
| 3,724,721 | 4/1973 | Barr | 222/83.5 |
| 3,749,324 | 7/1973 | Hyde | 241/195 X |
| 4,002,255 | 1/1977 | Fincham et al. | 414/412 |
| 4,279,558 | 7/1981 | Lavoie | 414/412 |
| 4,332,334 | 6/1982 | Mian | 222/83.5 |
| 4,404,879 | 9/1983 | Frohwerk et al. | 83/18 X |
| 4,527,716 | 7/1985 | Haas et al. | 222/83.5 |
| 4,557,825 | 12/1985 | Wittes et al. | 209/3 |
| 4,798,508 | 1/1989 | Lewis | 414/412 |
| 4,810,156 | 3/1989 | Pendleton et al. | 414/415 |
| 5,002,451 | 3/1991 | Hale et al. | 414/412 |
| 5,101,977 | 4/1992 | Roman | 209/3 |
| 5,141,135 | 8/1992 | Volk, Jr. | 222/105 |
| 5,161,442 | 11/1992 | Rilitz et al. | 83/493 X |
| 5,163,627 | 11/1992 | Bouche | 414/412 X |
| 5,188,500 | 2/1993 | Eide et al. | 414/412 |
| 5,190,429 | 3/1993 | Harlegard | 414/412 |
| 5,205,417 | 4/1993 | Herren | 209/630 |
| 5,219,064 | 6/1993 | Roman | 198/836.1 |
| 5,234,109 | 8/1993 | Pederson | 209/12 |
| 5,249,690 | 10/1993 | Patterson | 209/630 |
| 5,267,823 | 12/1993 | Roman | 414/412 |
| 5,352,082 | 10/1994 | Bennison | 414/412 |
| 5,368,431 | 11/1994 | Willey et al. | 414/412 |

OTHER PUBLICATIONS

BioCycle, May 1993, "Latest Developements in Debagging Systems," Pegi Ballister–Howells.

*Primary Examiner*—Michael S. Huppert
*Assistant Examiner*—James W. Keenan
*Attorney, Agent, or Firm*—Marger, Johnson, McCollom & Stolowitz

[57] ABSTRACT

A separation system tears apart trash bags in a manner that will ensure that the trash and recyclable material inside the bag will fall out onto a conveyer while at the same time maintaining the bag in substantially one piece. The bag is dropped onto two cylinders that rotate in opposite directions. The first cylinder hooks the container with a set of fins and then presents the bag to a second set of fins protruding from the second cylinder. The second set of fins have relatively dull tips that pull the bag apart allowing the contents inside the bag to drop down onto a conveyer. A set of steel fingers are attached between adjacent fins to prevent small bags from slipping though the system without first being broken. The fins automatically push the empty bags out of the system in substantially one piece.

27 Claims, 5 Drawing Sheets

BAG BREAKER

BACKGROUND OF THE INVENTION

This invention relates generally to the removal and separation of materials from containers and more particularly to a self cleaning bag breaking machine that allows broken bags to be easily separated from the contents contained inside the bag.

Several limitations exist in present efforts to recycle trash and compost materials such as yard debris. For example, compost materials must be bagged and laid out in front of a residence for pickup. Because yard debris is rather heavy when accumulated together or when wet, the container used for holding the debris must be made from a rather strong material. If the container is made from a biodegradable material, such as paper, the paper must, therefore, be extremely thick to adequately support the heavy yard debris contained inside. Heavy paper bags, however, are expensive and further add to the land fill. In addition, paper bags get wet when exposed to the environment and in turn have a tendency to break when transferred from the lawn of a residence to a refuse truck.

Plastic bags are generally stronger than paper bags and are, therefore, capable of retaining more refuse using less material than a paper bag. However, plastic bags are not quickly biodegradable. Plastic bags are typically shredded to remove the materials contained inside. However, if the plastic bag is used for holding compost, or other recyclable materials, the shredded pieces of the plastic bag will be inter-mixed with the compost materials previously contained inside the plastic bag. Therefore, plastic bags cannot be used for holding compost or other recyclable materials.

For example, systems have been established in many municipalities for recycling recyclable materials such as plastic, glass and aluminum. A major effort involved with the recycling process involves, first, removing the trash and other recyclable materials from the trash bag and then separating out the different recyclable materials removed from the trash bag.

Currently, trash and other recyclable materials are separated by throwing trash bags containing trash and other recyclable materials onto a set of sharp cutting blades. The blades shred the bags into hundreds of tiny pieces so that the contents of the bag fall out of the bag and onto a conveyer. The different recyclable materials are then separated. Slicing plastic or paper bags, however, does not always effectively remove all the contents from the bag. For example, the knives may only slice portions of the bag, essentially turning the bag into a net that still retains many larger objects.

To ensure that the contents of the bag are removed, the cutting blades are designed to completely shred the bag. However, when a trash bag is shredded, the hundreds of tiny pieces are intermingled with the trash and other recyclable materials previously stored inside the bag. Therefore, the task of separating out the different recyclable materials from the bag material becomes more time consuming and costly. In addition, plastic bags are a recyclable resource that cannot be effectively recycled due in major part to the cost involved with gathering the small shredded pieces.

Present debaggers are also easily clogged with plastic bags and additional refuse that attaches around the blades and other cutting apparatus. The debaggers must, therefore, be continuously down and cleaned out reducing system throughput and increasing recycling costs.

A wide variety of materials and sizes of containers are used to store trash and other recyclable materials. For example, trash and other recyclable materials are stored in small plastic grocery bags, paper bags, and in large 30 gallon plastic bags. Debagging equipment designed for processing 30 gallon plastic bags is often not effective in removing materials from smaller grocery bags. For example, smaller bags can slip through the blades of the debagging equipment and remain intact when dropped onto a conveyer. Thus, a debagging system must be readjusted or separate systems used according to the size of the trash bags.

Accordingly, a need remains for a low cost self cleaning debagging machine that can effectively remove materials from a wide variety of trash bag sizes and materials.

SUMMARY OF THE INVENTION

It is, therefore, an object of the invention is to increase the adaptability of separation systems to remove trash and other recyclable materials from a wider variety of trash bags.

Another object of the invention is to reduce the amount of time and money required to separate trash bags from the materials contained inside the trash bag.

A further object of the invention is to reduce the time and effort required to maintain a trash and other recyclable material separation system in an operating condition.

A trash and other recyclable material separation system tears apart bags in a manner that ensures that the contents of the bag fall out onto a conveyer while at the same time maintaining the bag in substantially one piece. The bag is dropped onto two cylinders that rotate in opposite directions. The first cylinder hooks the bag with a set of fins and then presents the bag to a second set of fins protruding from the second cylinder.

The first set of fins rotate at a relatively slow speed and the second set of fins rotate in an opposite direction at a relatively high speed. The second set of fins have relatively dull tips that instead of cutting the bag actually pull the bag apart. The speed differential between the first and second set of fins serve to stretch the bag apart until the bag eventually breaks. Because the bag is stretched to such an extreme, a large tear is created in the bag that readily allows all the contents inside the bag to fall out.

One advantage of the system is that the bag remains in substantially one piece. Thus, the bag can be quickly and easily removed from the other contents dislodged from the bag.

The shape of the fins in combination with the direction of fin rotation allow the system to automatically clean itself. For example, after the bag is broken, the bag may remain attached onto the first set of fins. The second set of fins automatically pull the bag off the first set of fins onto the receiving conveyer. In addition, the rotation of the first and second set of fins naturally force materials down onto the conveyer. Thus the system does not have to be continuously down to be unclogged.

A set of steel fingers are attached between adjacent fins and hook onto small bags that could otherwise slip though the system without being broken. Each finger is fabricated from a piece of spring steel that slows the decent of the bag enough for the second set of fins to pull the bag apart. Thus, the system is effective in breaking both large and small bags without having to readjust the fin spacing.

The foregoing and other objects, features and advantages of the invention will become more readily apparent from the following detailed description of a preferred embodiment of the invention which proceeds with reference to the accompanying drawings.

DETAILED DESCRIPTION

Figure 1:
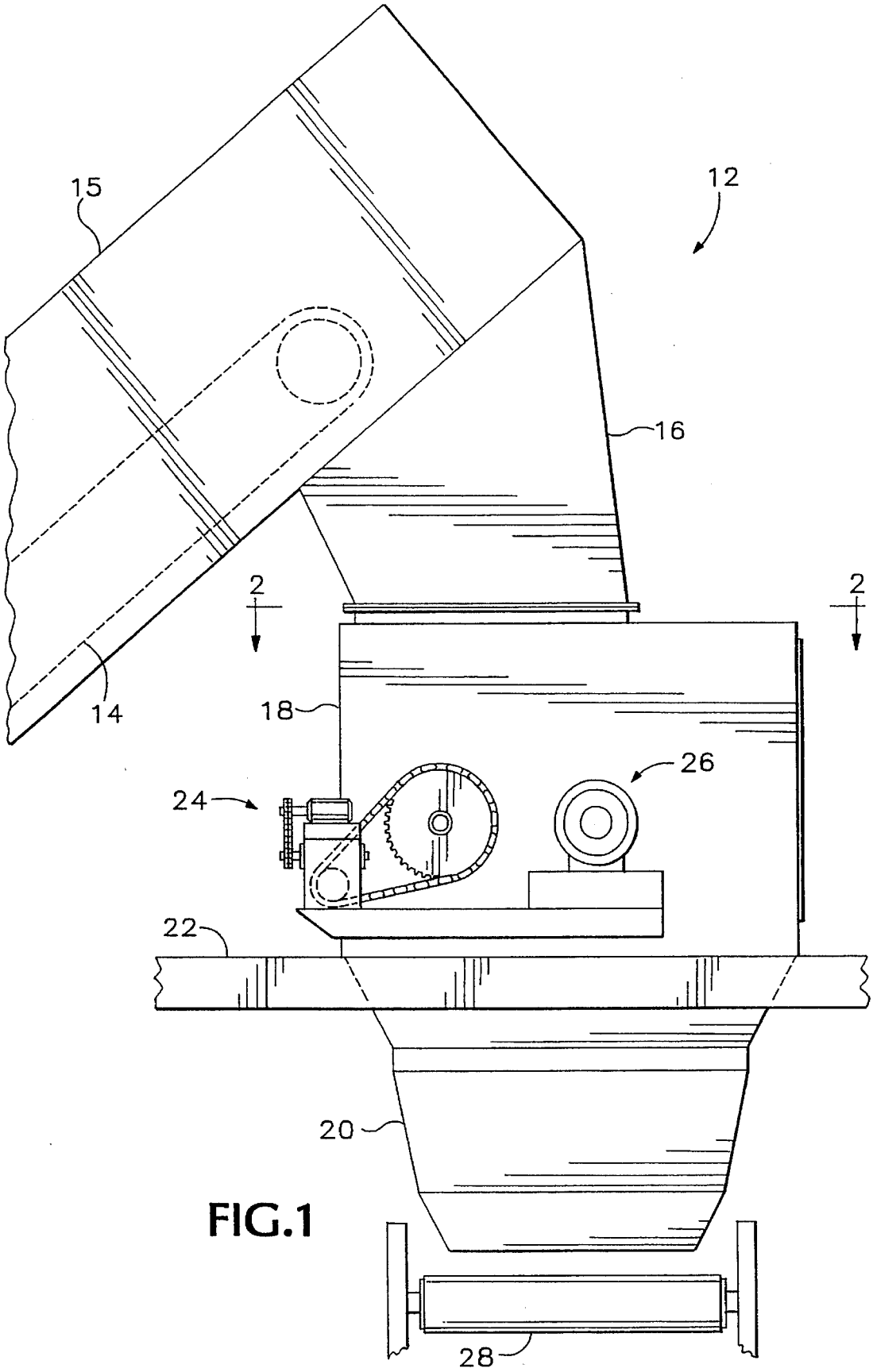
FIG. 1 is a front elevation view of a trash and recyclable material separation system according to the invention.

FIG. 1 is a front elevation view of a trash and recyclable material separation system 12 according to the invention. A conveyer 14 moves inside an enclosure 15 transporting trash bags (see FIG. 3) into a receiving chute 16. The trash bags fall through chute 16 into a bin 18 containing cylinders that break open the trash bags. The broken bags and the contents of the bags are discharged out through the bottom of bin 18 through a discharge chute 20 onto a conveyer 28. The cylinders inside bin 18 are operated by a first drive system 24 and a second drive system 26. A platform 22 supports the bin 18 and allows personnel to easily access the trash and recyclable material separation system.

Figure 2:
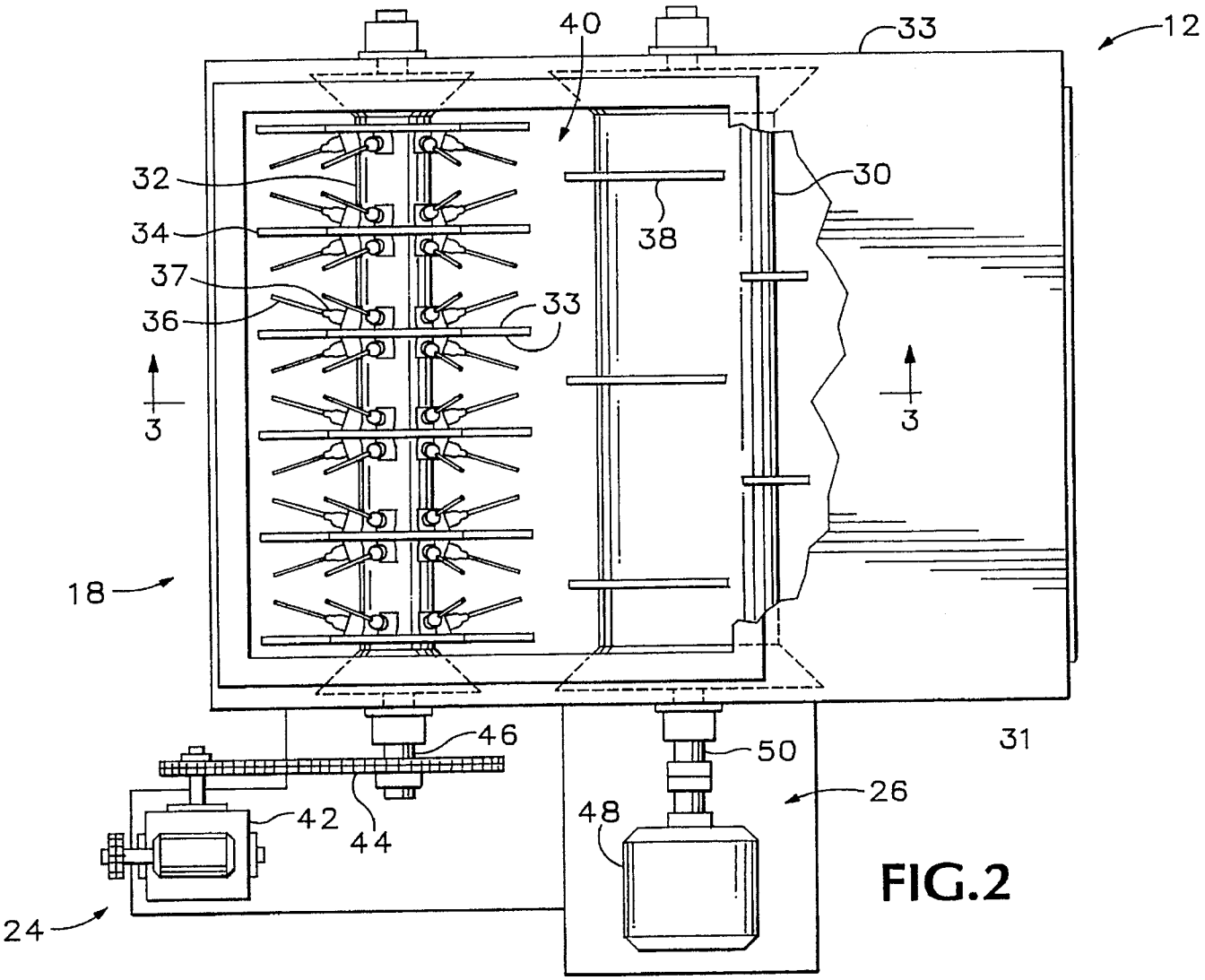
FIG. 2 is a top plan view taken along lines 2—2 in FIG. 1.

FIG. 2 is a top plan view of the trash and recyclable material separation system 12 taken along lines 2—2 in FIG. 1. An opening 40 in the top of bin 18 receives the bags dropped into receiving chute 16 (FIG. 1). A first elongated cylinder 32 extends from a front side 31 to a back side 33 of bin 18. A first set of fins 34 are spaced at equal distances across and around the first cylinder 32. Multiple fingers 36 reside around cylinder 32 on opposite sides of each fin 34. Each finger 36 is attached to the cylinder 32 via an elastic member 37 mounted near the base of the fin 34. The finger is angled laterally away from the base of the associated fin.

A second elongated cylinder 30 extends from the front side 31 to back side 33 of bin 18 in a parallel alignment with cylinder 32. A second set of fins 38 are spaced both across and around the second cylinder 30. Fingers 38 are aligned in a parallel arrangement half way between laterally adjacent fins 34 on the first cylinder 32. Fins 34 and the first cylinder 32 are referred to as a catch mechanism having catch fins 34. Cylinder 30 and fins 38 are referred to as a pull mechanism having pull fins 38..

The first drive system 24 includes a motor 42 that drives a chain 44 in turn rotating a shaft 46. Shaft 46 rotates cylinder 32 about an elongated central axis. Drive system 26 includes a motor 48 that drives shaft in turn rotating cylinder 30. The motor controllers used to control the speed and direction of rotation of motors 42 and 48 are known to those skilled in the art and are,therefore, not described in detail.

Figure 3:
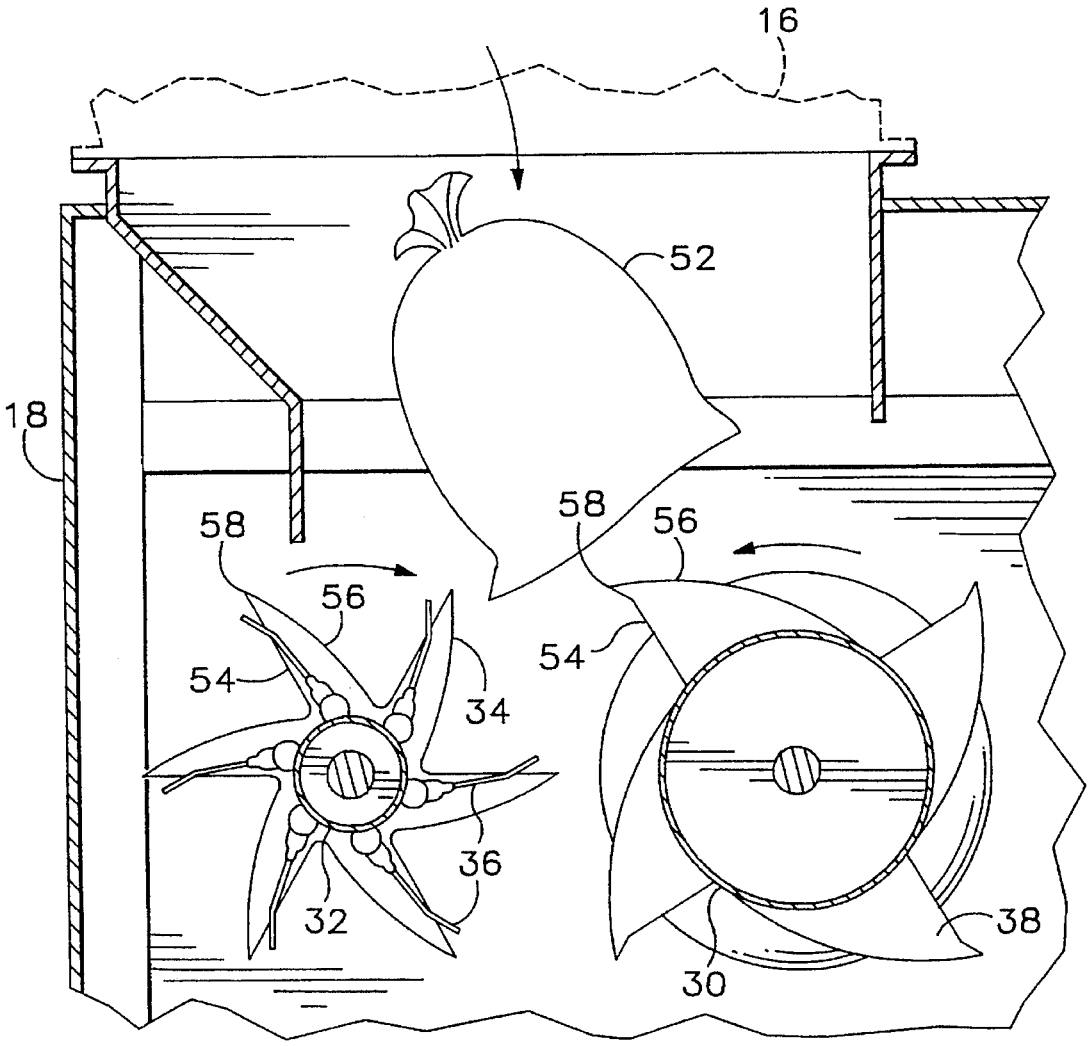
FIG. 3 is a partial front section view taken along lines 3—3 in FIG. 2 showing dual cylinders prior to receiving a container.

FIG. 3 is a partial front section view taken along lines 3—3 in FIG. 2 showing cylinders 32 and 30 prior to receiving a plastic bag 52. It can be seen that the fins 34 and 38 are spaced radially about cylinders 32 and 30, respectively. Both fins 34 and 38 each comprises a first side 54 extending substantially perpendicular from the cylinder up to a fin tip 58. A second convex side 56 extends from a substantially tangential relationship with the cylinder up to the fin tip 58. The first and second sides of each fin 38 on cylinder 30 is shaped in substantially the same manner on the fins 34 on cylinder 32 except that the convex side on fins 34 are sloped at a greater angle.

Each fin on cylinder 30 has a tip 58. The tip 58 is defined where sides 54 and 56 intersect together forming an outer edge with a radius of approximately 3/16ths inches. Each fin 34 and 38 is approximately between one inch and one and one-half inches thick between opposite lateral side faces 33 (FIG. 2). Motor 42 rotates cylinder 32 in a clock-wise directions and motor 48 rotates cylinder 30 in a counter clock-wise direction.

After traveling up conveyer 14, Bag 52 is deposited through receiving chute 16 onto the top of fins 34 and 38. The shape, thickness and rotational speed of the fins are important for ensuring that bag 52 is ripped open as opposed to being shred open. For example, if too thin, the fins will slice bag 52 into a net and not allow all the contents in the bag to fall out. In addition, if bag 52 is shredded, little pieces of the bag will drop onto the conveyer 28 (FIG. 1) making separation of the bag 52 from the other contents difficult.

Cylinder 32 and 30 are, therefore, rotated at different speeds according to the type of bag material and the type of materials inside the bag. In one example, cylinder 32 is rotated between 2–15 rotations per minute (RPM's) and cylinder 30 is rotated multiple times faster than cylinder 32. The rotational speed ratio between cylinder 32 and 30 are again changed according to the specific materials being processed.

Figure 4:
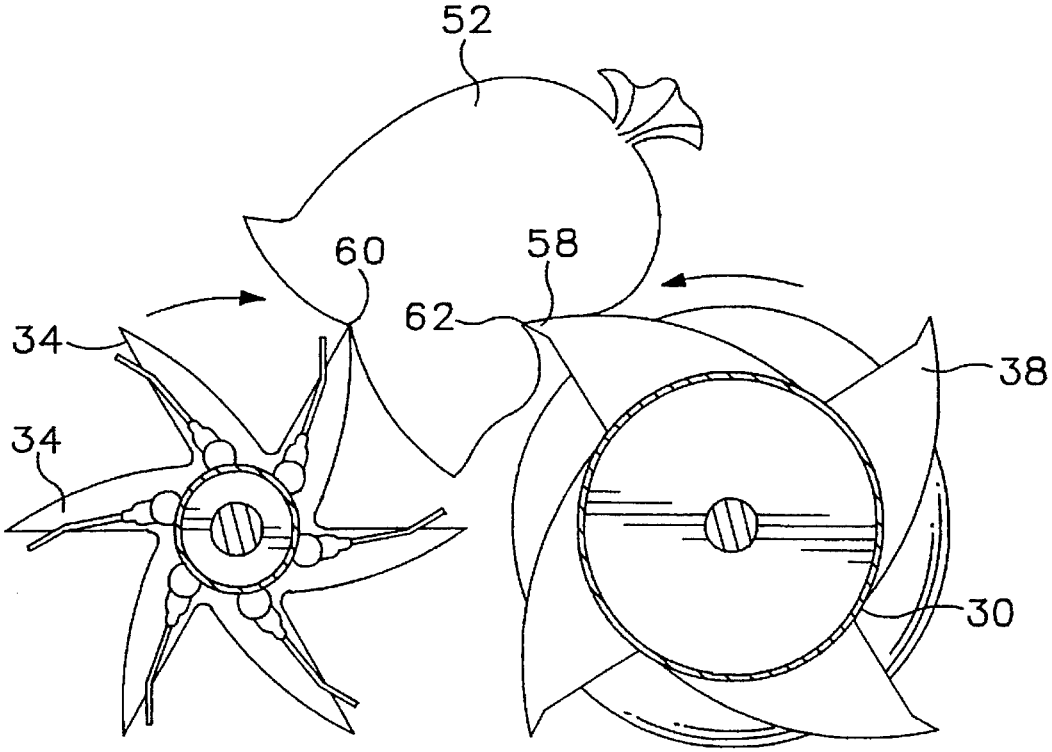
FIG. 4 is an isolated side view of the cylinders in FIG. 3 shown while initially receiving the container.

FIG. 4 is an isolated side view of the cylinders in FIG. 3 shown while initially receiving bag 52. Upon falling into bin 18, bag 52 is hooked by fins 34 at a first location 60. Fins 34 serve to slow the speed of bag 52 while descending through chute 16. The clockwise rotation of fins 34 move bag 52 to the right and downward presenting the bag to fins 38.

The second set of fins 38 rotate in a counter clock-wise direction with tip 58 angled toward bag 52. Tip 58 hooks into a second location 62 on bag 52. The relatively blunt tip 58 on fins 38 hook into bag 52 without slicing through the plastic material. Cylinder 30 is rotated at a substantially greater speed than cylinder 32. Thus, fins. 38 pull location 62 on bag 52 down much faster than fins 34 allow bag location 60 to descend. Thus, fins 38 stretch bag locations 62 and 60 apart until bag 52 eventually tears as shown in FIG. 5.

Figure 5:
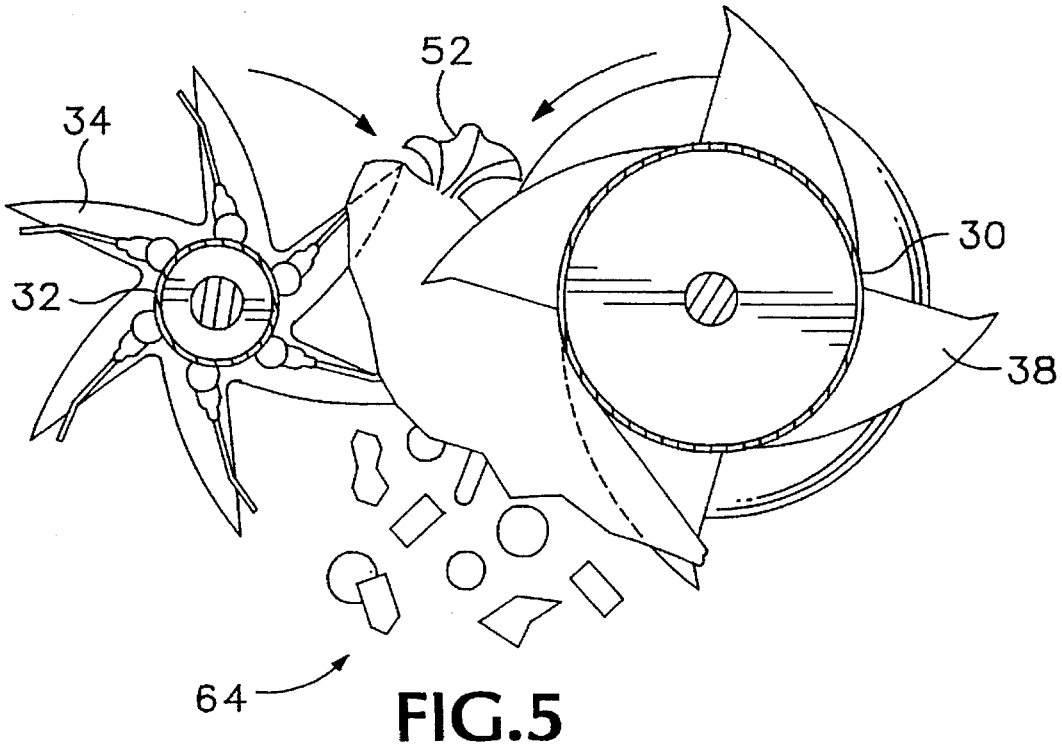
FIG. 5 is an isolated side view of the cylinders of FIG. 3 shown while ripping the container.

Referring to FIG. 5, fins 34 and 38 stretch the plastic material of bag 52 until bag 52 eventually tears. Because the bag is in a stretched condition, a large tear is created in bag 52 that allows all the contents 64 in bag 52 to fall out. Cylinders 30 and 32 are spaced a sufficient distance apart so that bottles, cans and other recyclable materials fall between the two cylinders onto conveyer 28 (FIG. 1). Cylinder 32 also helps push the contents 64 and bag 52 through the space between cylinders 32 and 30. Because the bag 52 is torn and not shredded, the bag remains in substantially one piece.

Figure 6:
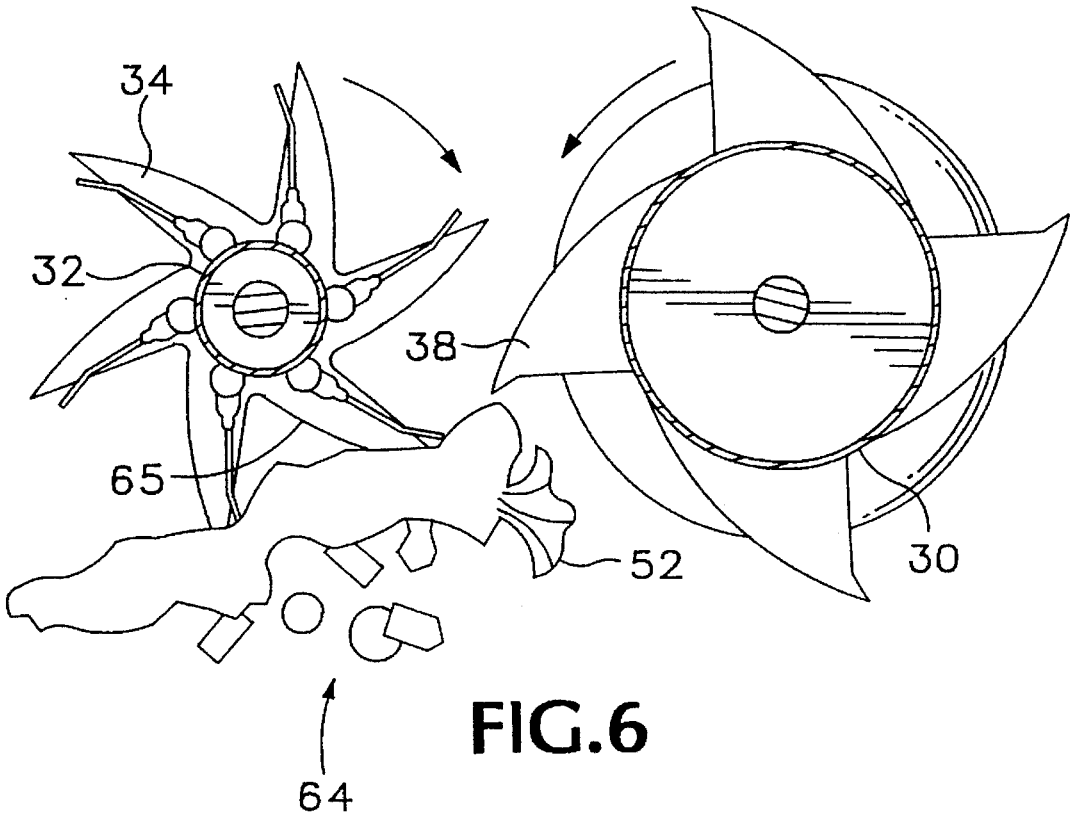
FIG. 6 is an isolated side view of the cylinders of FIG. 3 shown while discarding the container.

FIG. 6 shows the trash bag 52 after trash bag 52 is removed. After removal of contents 64, in many instances bag 52 remains attached to fins 34. However, when a fin 65 rotates downward at an appropriate angle as shown in FIG. 6, fins 38 will pull bag 52 off of fin 65. Bag 52 then drops onto conveyer 28 (FIG. 1) in one single piece. Thus, fins 38 in addition to breaking bag 52, also serve to help remove bags and assorted accumulating materials attached onto fins 34.

Motors 42 and 48 (FIG. 2) include control units that adjust the speed of cylinders 32 and 30, respectively, according to the type of materials dropped into bin 18. Thus, the speed of fins 34 and 38 properly tear bags regardless of the type of bag material. Motor control systems that maintain a constant shaft torque are known to those with average skill in the art and are, therefore, not described in detail.

Referring back to FIGS. 2 and 3, fingers 36 prevent small bags from squeezing between adjacent fins on cylinder 32. For example, small grocery bags could be potentially pushed between fins 32 without being torn by fins 38. However, fingers 36 ensure that small bags will be hooked prior to transcending between the fins 34.

A bag squeezing between the fins 34 will hook onto the fingers 36 bending the fingers 36 slightly downward. The fingers 36 slow the decent of the bag until fins 38 pull the bag apart in a manner similar to that described above. After the bag is broken apart, fingers 36 spring back into their original position. Fingers 36 are optional and may be removed if only large bags are deposited into bin 18 or if fins 34 are placed closer together.

The number of fins, the spacing distance between fins, and the spacing distance between shafts can all be varied according to the type of trash or other recyclable materials being processed. However, using fingers 36 allow a wider variety of materials and trash bags to be processed with a single system arrangement. The fins 34 and 38 operate as described above equally as well for paper or plastic bags of variable thicknesses.

The system described above removes material from a wide variety of bags having different sizes, shapes and made from different materials while maintaining the broken bag in a single unitary piece. Because the bag remains in one piece, the broken bag is easily separated from the other contents previously contained in the bag. By being self cleaning, the system minimizes machine down time and maintenance.

Having described and illustrated the principles of the invention in a preferred embodiment thereof, it should be apparent that the invention can be modified in arrangement and detail without departing from such principles. I claim all modifications and variation coming within the spirit and scope of the following claims.

We claim:

1. A method for removing materials from a container, comprising:

providing a set of pull fins attached to a rotatable cylinder;

dropping the container against a catch mechanism that hooks onto a first portion of the container thereby presenting the container to the pull fins, the catch mechanism spaced a given distance laterally away from the pull fins;

rotating the cylinder in a circular manner thereby causing the pull fins to hook onto a second portion of the container spaced a lateral distance away from the first portion;

rotating the cylinder further causing the pull fins to move away from the catch mechanism pulling the first and second portions of the container apart a sufficient distance to tear the container open thereby allowing the materials inside the container to fall out; and moving the catch mechanism so that the pull fins pull the container off the catch mechanism.

2. A method according to claim 1 including locating the catch mechanism a sufficient distance from the pull mechanism so that bottles, cans and other recyclable material in said container fall between the catch mechanism and the pull mechanism after the container is torn open.

3. A method according to claim 1 wherein the catch mechanism includes a set of catch fins attached to a catch cylinder and including the following steps:

rotating the catch fins in a given direction opposite to the rotational direction of the pull fins;

orienting the catch fins to tilt in a direction away from the given rotational direction of the catch fins; and orienting the pull fins to tilt in a direction toward the rotational direction of the pull fins.

4. A method according to claim 3 wherein the pull fins are rotated at a greater speed than the hook fins, the speed difference between the catch fins and pull fins determining the rate at which the first and second portions of the container are stretched apart.

5. A method according to claim 4 including sizing and rotating both the pull fins and the catch fins in a manner so that the container remains in substantially one piece after being ripped open.

6. A method according to claim 3 including adjusting the rotational speed of the pull fins according to various types of materials contained in the containers and the type of container.

7. A method according to claim 3 including adjusting the speed of the catch fins according to the type of material used for forming the container.

8. A method according to claim 1 wherein the pull fins automatically remove containers from the catch mechanism after the materials inside the container fall out by further rotating the cylinder until the empty container is pulled free from the catch mechanism and thereafter continuing rotation until the container drops from the pull fins.

9. A system for removing materials from a container, comprising:

a first cylinder;

means for rotating the first cylinder in a first rotational direction and at a first rotational speed;

a first set of fins that protrude from an outside surface of the first cylinder, said first set of fins being oriented to hook the container at a first location when the container drops onto the first cylinder and onto the first set of fins responsive to gravity acting on the container;

a second cylinder spaced a given distance from the first cylinder;

a second set of fins that protrude from an outside surface of the second cylinder a given lateral distance apart from one of the first set of fins, the container moved by the first set of fins against the second set of fins;

means for rotating the second cylinder in a second rotational direction and at a second rotational speed greater than the first rotational speed of the first cylinder so that the second set of fins hook onto a second location of the container spaced laterally from the first location stretching the second location of the container further apart from the first location at a rate proportional to a speed differential between the first rotational speed and the second rotational speed until the container tears open allowing the materials inside the container to fall out.

10. A system according to claim 9 wherein the first set of fins extend out from the first cylinder at an angle directed away from the rotational direction of the first cylinder and the second set of fins extend out from the second cylinder at an angle directed toward the rotational direction of the second cylinder.

11. A system according to claim 10 wherein the first cylinder includes a given diameter less than half a given diameter of the second cylinder.

12. A system according to claim 9 including multiple fingers extending radially from the outside surface of the first cylinder in predefined positions between horizontally adjacent fins, the fingers rotated about a central axis of the first cylinder so that the fingers are temporarily displaced in various radial orientations in relation to the first cylinder and springingly repositioned into said predefined position.

13. A system according to claim 12 wherein each finger comprises a rod made from spring steel hingedly attached to the first cylinder via an elastic member.

14. A system for removing materials from a container, comprising:

a first cylinder having a first set of fins that protrude from an outside surface;

means for rotating the first cylinder in a first rotational direction and hooking the first set of fins onto a first location on the container;

a second cylinder spaced a given distance from the first cylinder, the second cylinder having a second set of fins that protrude from an outside surface; and means for rotating the first and second set of fins in opposite directions and rotating the first cylinder at a slower speed than the second cylinder so that the second set of fins hook and pull a second location of the container apart from the first location thereby tearing the container open and allowing the materials inside the container to fall out;

each fin comprising a first side extending substantially perpendicular from the cylinder surface out to a fin tip and a second concaved side extending from a substantially tangential relationship with the cylinder surface up to the fin tip, the first and second sides of each fin on the first and second cylinder orientated in substantially the same manner.

15. A system according to claim 14 wherein each fin on the second cylinder has a tip defined at the outside edge where the first and second sides intersect, the tip having a radius of approximately 3/16ths inches.

16. A system according to claim 15 wherein each fin has a thickness between a set of opposite lateral side faces of between one inch and one and one-half inches.

17. A bag breaking system for removing material from a bag, comprising:

catch cylinder having an outside circumference with a given diameter;

catch fins spaced radially around the catch cylinder and angled in a direction tangential with the outside circumference of the catch cylinders for hooking the bag at a first location, the bag when initially fed into the bag breaking system falling by gravity onto the catch fins and moved by the catch fins toward a main cylinder;

the main cylinder elongated about a central axis and aligned adjacent to the catch cylinder and having an outside circumference with a given diameter;

multiple pull fins spaced both radially about the main cylinder and horizontally spaced from laterally adjacent to each other catch fins, each pull fin angled in a direction tangential with the outside circumference of the main cylinder for hooking onto a second location on the bag spaced laterally from the first location; and drive means for rotating the main cylinder about the central axis at a give rotational speed stretching the second location of the bag away from the first bag location thereby tearing the bag and allowing the materials inside said bag to fall out.

18. A system according to claim 17 wherein the drive means rotate the catch cylinder in the opposite direction of the main cylinder and at a rotational speed less than the given rotational speed of the main cylinder.

19. A system according to claim 17 wherein the diameter of the catch cylinder is less than half the diameter of the main cylinder.

20. A system for removing materials from a container, comprising:

a first cylinder having a first set of fins that protrude from an outside surface;

means for rotating the first cylinder in a first rotational direction and hooking the first set of fins onto a first location on the container;

a second cylinder spaced a given distance from the first cylinder, the second cylinder having a second set of fins that protrude from an outside surface; and a motor for rotating the first and second cylinder in given rotational directions so that the first set of fins hook a first location of the container and the second set of fins hook and pull a second location of the container away from the first location thereby tearing the container open and allowing the materials inside the container to fall out;

the first set of fins each having associated tips tilted in a direction away from the rotational direction of the first cylinder and the second set of fins each having associated tips tilted in a direction toward the notational direction of the second cylinder.

21. A system according to claim 20 wherein the first and second set of fins each comprise a first side extending substantially perpendicular from the cylinder surface out to a tip and a second concaved side extending from a substantially tangential relationship with the cylinder surface up to the fin tip.

22. A system for removing materials from a container, comprising:

a first cylinder having a given diameter;

a first set of fins that protrude from an outside surface of the first cylinder to associated tips;

means for rotating the first cylinder in a first rotational direction and hooking the first set of fins onto a first location on the container;

a second cylinder having an outside surface having a given diameter that extends uniformly between opposite lateral ends, the diameter of the second cylinder being over twice the diameter of the first cylinder, a second set of fins that protrude from the outside surface of the second cylinder to associated tips, the second set of fins positioned at various longitudinal positions across the second cylinder;

means for rotating the second cylinder in a second rotational direction so that the second set of fins hook onto a second location of the container spaced from the first location and stretching the second location of the container further apart from the first location and against the second cylinder until the container rips open.

23. A system according to claim 22 wherein the tips of the first set of fins are pointed in a direction away from the first rotational direction and the tips from the second set of fins are pointed in a direction toward the second rotational direction.

24. A system according to claim 22 including multiple spring fingers extending radially about the outside surface of the first cylinder for slowing container movement between the first and second cylinders.

25. A system according to claim 24 wherein only two of the second set of fins are located at each longitudinal position on the second cylinder.

26. A system according to claim 22 wherein the second set of fins at each longitudinal position are spaced a given radial distance apart, the given radial distance sufficient to allow a first fin at the longitudinal position to tear apart the container before a second fin at the same longitudinal position contacts the same container.

27. A system for removing materials from a container, comprising:

a first cylinder having a first set of fins that protrude from an outside surface to associated tips;

means for rotating the first cylinder in a first rotational direction and hooking the first set of fins onto a first location on the container;

a second cylinder having a second set of fins that protrude from an outside surface to associated tips;

means for rotating the second cylinder in a second rotational direction so that the second set of fins hook onto a second location of the container spaced from the first location thereby stretching the second location of the container further apart from the first location until the container rips open; and multiple spring fingers extending radially from the outside surface of the first cylinder for slowing container movement between the first and second cylinders, each spring finger angled toward a center position between laterally adjacent fins.

* * * * *

UNITED STATES PATENT AND TRADEMARK OFFICE

CERTIFICATE OF CORRECTION

PATENT NO. : 5,484,247
APPLICATION NO. : 08/243849
DATED : January 16, 1996
INVENTOR(S) : Clark et al.

It is certified that error appears in the above-identified patent and that said Letters Patent is hereby corrected as shown below:

Column 8, line 29, replace “notational” with --rotational--

Signed and Sealed this

Third Day of October, 2006

JON W. DUDAS
*Director of the United States Patent and Trademark Office*